US006416131B1

(12) United States Patent
Changkeun

(10) Patent No.: US 6,416,131 B1
(45) Date of Patent: Jul. 9, 2002

(54) ADJUST BUTTON OF GAS CYLINDER OF CHAIR USED AS PALM MESSAGE

(76) Inventor: Ryu Changkeun, No. 402-161 Eungam-dong, Eunpyung-Ku, Seoul (KR)

( * ) Notice: Subject to any disclaimer, the term of this patent is extended or adjusted under 35 U.S.C. 154(b) by 0 days.

(21) Appl. No.: 09/484,009

(22) Filed: Jan. 18, 2000

(51) Int. Cl.[7] ..... A47C 1/024

(52) U.S. Cl. ..... 297/344.19; 297/217.1; 297/362.13; 297/463.2; 601/131

(58) Field of Search ..... 297/344.19, 217.1, 297/362.13, 463.1, 463.2; 601/115, 118, 128, 131

(56) References Cited

U.S. PATENT DOCUMENTS 2,797,685 A * 7/1957 Packwood ..... 601/131
2,806,469 A * 9/1957 Bergholt ..... 601/131
5,580,336 A * 12/1996 Coallier ..... 601/131 X
5,765,921 A * 6/1998 Chuang ..... 601/118 X
6,019,429 A * 2/2000 Tedesco ..... 297/463.1 X

* cited by examiner

*Primary Examiner*—Peter R. Brown
(74) *Attorney, Agent, or Firm*—Harrison & Egbert

(57) ABSTRACT

This invention relates to the adjustment button to control the control valve of gas(oil) cylinder for adjustment of height of swivel chair. It can be or of slant of swivel chair and simultaneously used as the palm massage to stimulate a respective portion of human body and accordingly stimulate the human body to guarantee healthy living. The push button means 300 is connected to the control valve of gas cylinder 200 via wire cable 400 and not only provides adjustment function to adjust the height of seat 110 of swivel chair or slant of back 120 of chair, but also can be used palm massaging means 500 to massage the palm.

3 Claims, 4 Drawing Sheets

ADJUST BUTTON OF GAS CYLINDER OF CHAIR USED AS PALM MESSAGE

TECHNICAL FIELD

This invention relates to the adjustment button of the gas(oil) cylinder used as the palm massage in the swivel chair. In particular, this invention relates to the adjustment button to control the control valve of gas(oil) cylinder for adjustment of height of swivel chair or of slant of swivel chair. It can be simultaneously used as the palm massage to stimulate a a respective portion of human body and accordingly stimulate the human body to guarantee the healthy living.

BACKGROUND ART

In general, gas(oil) cylinder has been commonly used for adjustment of height of chair or slant of back of chair. The control valve of which is operated by gas pressure obtained throughout operation of valve pin via push button to provide the contraction movement of gas cylinder that results in the up and down movement of the seat enabling height of chair or slant of back to adjust to the body size of user.

For operation of the gas cylinder, two methods are introduced by the Japanese patent No. 55-14643 and No. 55-21629.

One method is to operate the gas cylinder utilizing the lever and the other is to introduce wire cable therein and operate gas cylinder by a push button formed on the arm rest, wherein the one end of wire cable is connected to a control valve pin of gas cylinder while the other end of it is connected with the push button so as to provide the contraction movement of gas cylinder via push button for adjustment of height of chair and slant of back of chair.

From the construction, upon the push operation of the button, the gas cylinder adjusts the height of seat or slant of back so that user can sit down on the seat, which is matched with the size of user's body.

However, the conventional gas cylinder adopting push button type adjustment method is only directed to the one object, that is, for adjustment operation of height of chair and slant of back of chair.

Another prior art is introduced by the Japanese utility Patent No. 45-6517.

The above art is comprised of an chair's armrest having palm pressing means. And the palm massaging means is installed in recess hole containing a massage palm ball with coil spring.

The above palm massage means has an effect on user's health by massaging the massage ball.

Meanwhile, the above prior art cannot provide palm massaging means and the control push button means to control gas cylinder.

SUMMARY OF THE INVENTION

This invention is designed to attain two goals with one construction, that is, to provide the push button capable of adjusting the height of chair or slant of back of chair and simultaneously to enable the human body to be active by adopting the palm press pressing the palm related to the respective portion of human body and accordingly can guarantee heath living.

This invention provides the push button having the protrusions on its upper surface enabling the massaging means. The button is connected with wire cable for controlling control valve of gas cylinder for adjustment of seat height of swivel chair and of slant of back.

The outstanding characteristics and advantages can be understood in conjunction with the accompanying drawings.

DETAILED DESCRIPTION OF THE DRAWINGS

Figure 1:
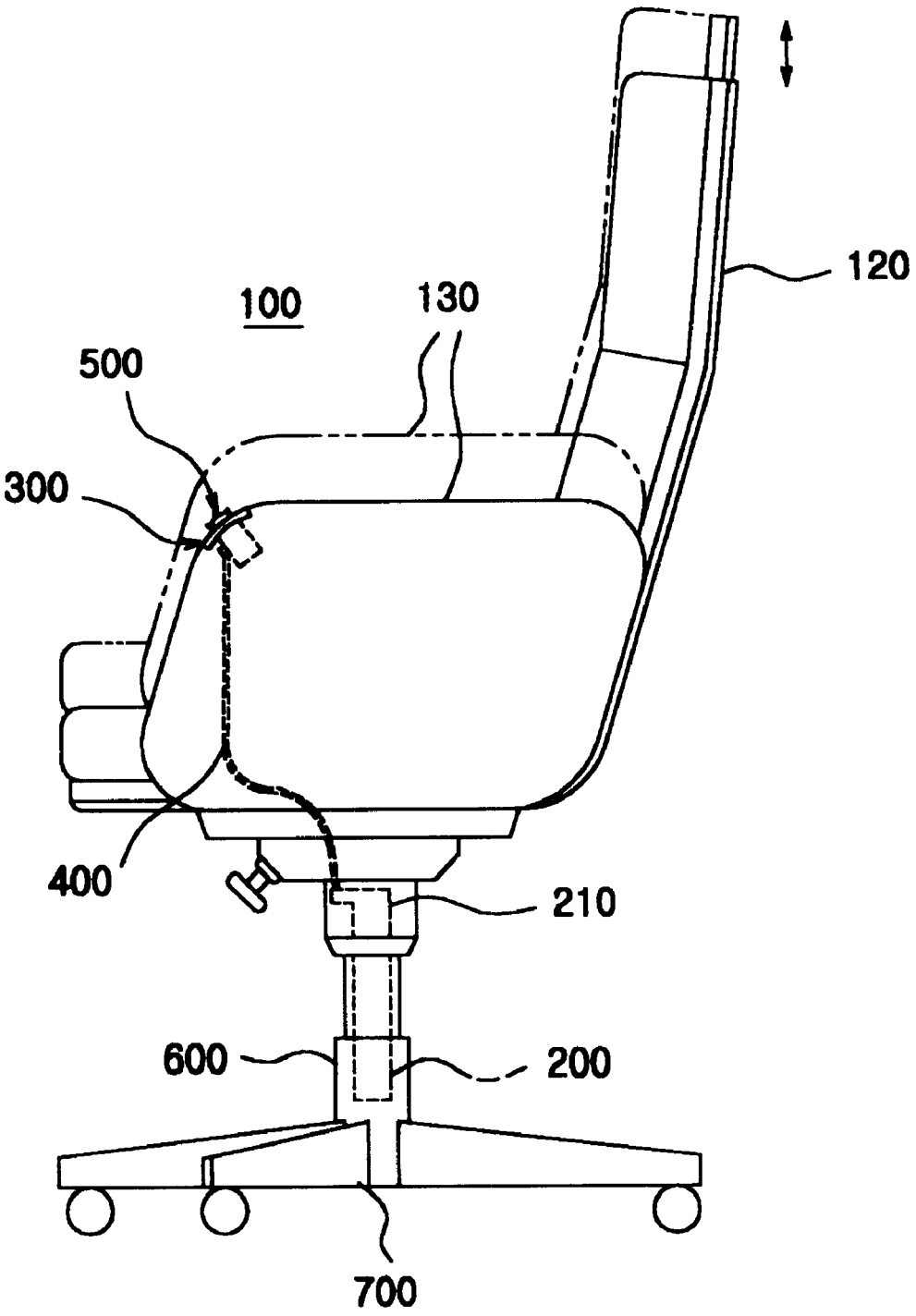
FIG. 1 is the schematic side view of the chair adopting oil-cylinder for adjustment of height made in accordance with this invention.

As shown in FIG. 1, this invention comprises the wire cable 410 to operate control rod 230 of gas cylinder mounted in the base 600 for adjustment of seat of chair and push button means 300 connected thereon and formed on the arm rest 130 of swivel chair 100.

Figure 3:
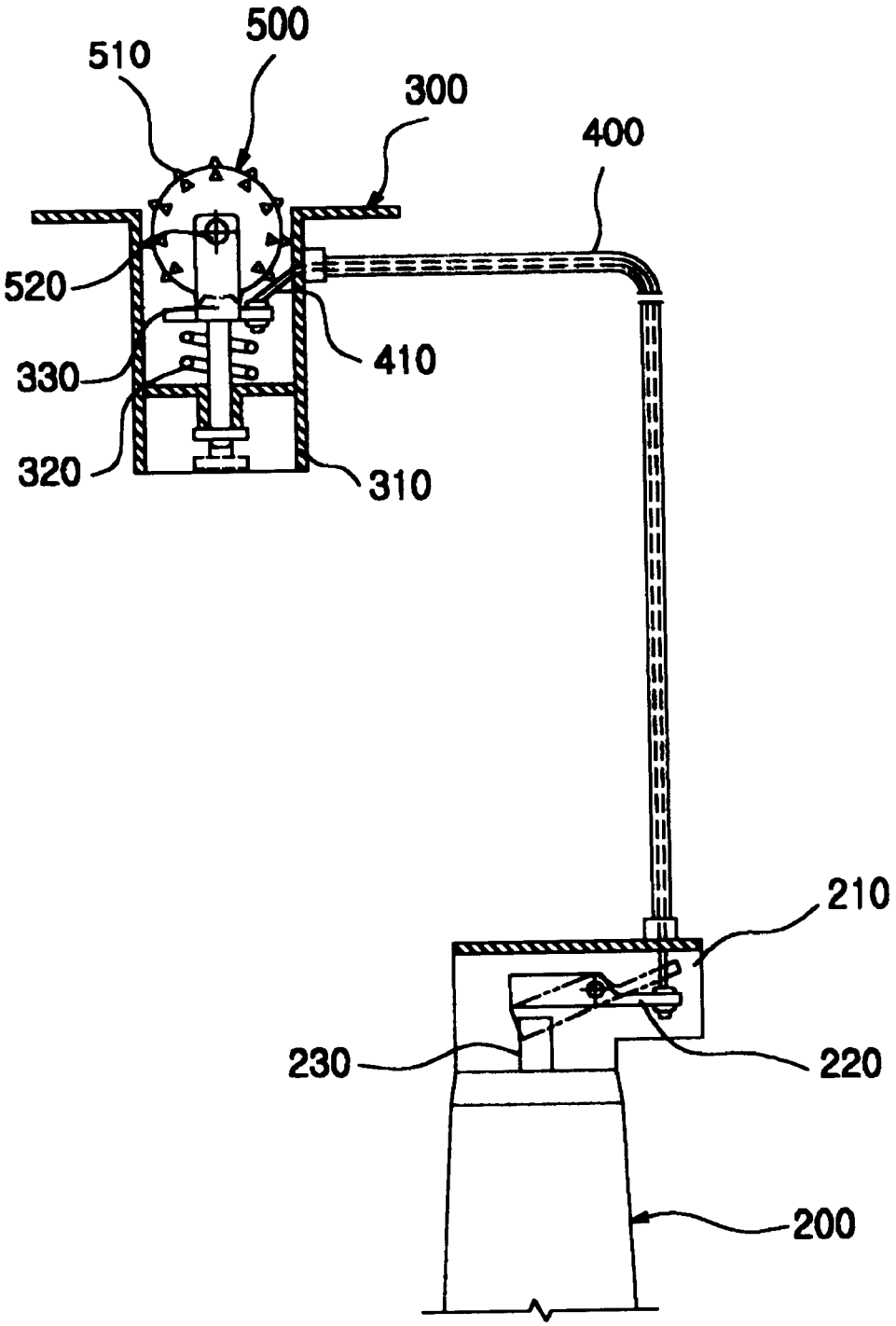
FIG. 3 is a brief sectional view showing adjustment button of gas cylinder for chair used as a palm press means in accordance with this invention.

Here, the push button means 300 is the palm massaging means 500 having protrusions 510 on its exterior surface to massaging the palm of the hand As shown in FIG. 3.

FIG. 1 is the one embodiment in accordance with this invention applied to the height adjustment typed of chair, wherein the height of seat of chair is adjusted by the gas cylinder 200 mounted in the base 600 of the swivel chair so as to allow the user to sit down on it conveniently.

In this embodiment, the push button means 300 connected with control valve of gas cylinder 210 via wire cable 400 and formed on slope of the arm rest 130 not only provides adjustment function to adjust the height of seat 110 of swivel chair illustrated as supposed line in FIG. 1, but also provides massaging function with the palm of hand. The massaging function with the palm of hand helps circulation of blood and accordingly can stimulate the whole body.

FIG. 3 is the cross-sectional view showing the relevant composition among palm massaging means 500 of push button means 300 formed on the slope of the armrest. Gas cylinder 210 and wire cable are essentials in this invention.

Here, push button used as the palm massaging means 500 is designed to have the protrusions on its exterior surface and rotary axis 520 and mounted with spring 320 on the tension base 450 so as to be moved upwardly and downwardly, being rotated therein in the case 310.

Figure 2:
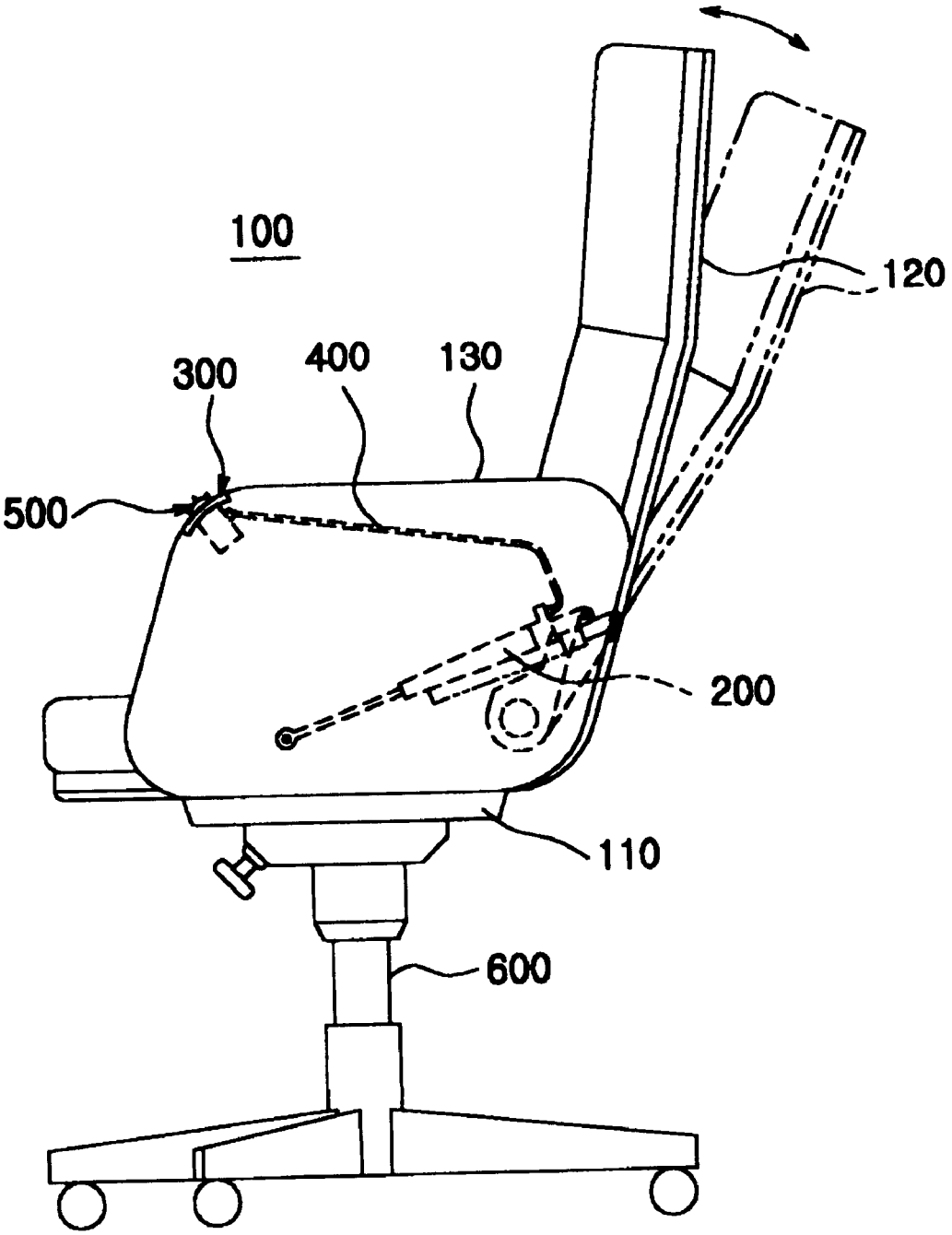
FIG. 2 is the schematic side view of the chair adopting oil-cylinder for adjustment of slant of chair in accordance with this invention.

FIG. 2 is the another embodiment of this invention applied to the slant adjustment type of chair, wherein the slant of back of chair is adjusted by the gas cylinder 200 mounted in the arm rest 130 member of the swivel chair so as to allow the user to sit down on it conveniently. The push button means 300 connected to control valve of gas cylinder 200 formed on the arm rest 130 by control rod 230 not only provides adjustment function to adjust the slant of back 120 of swivel chair, but also provides the massaging function with the palm of hand. The massaging function with the palm of hand helps circulation of blood and accordingly can stimulate the whole body.

Figure 4:
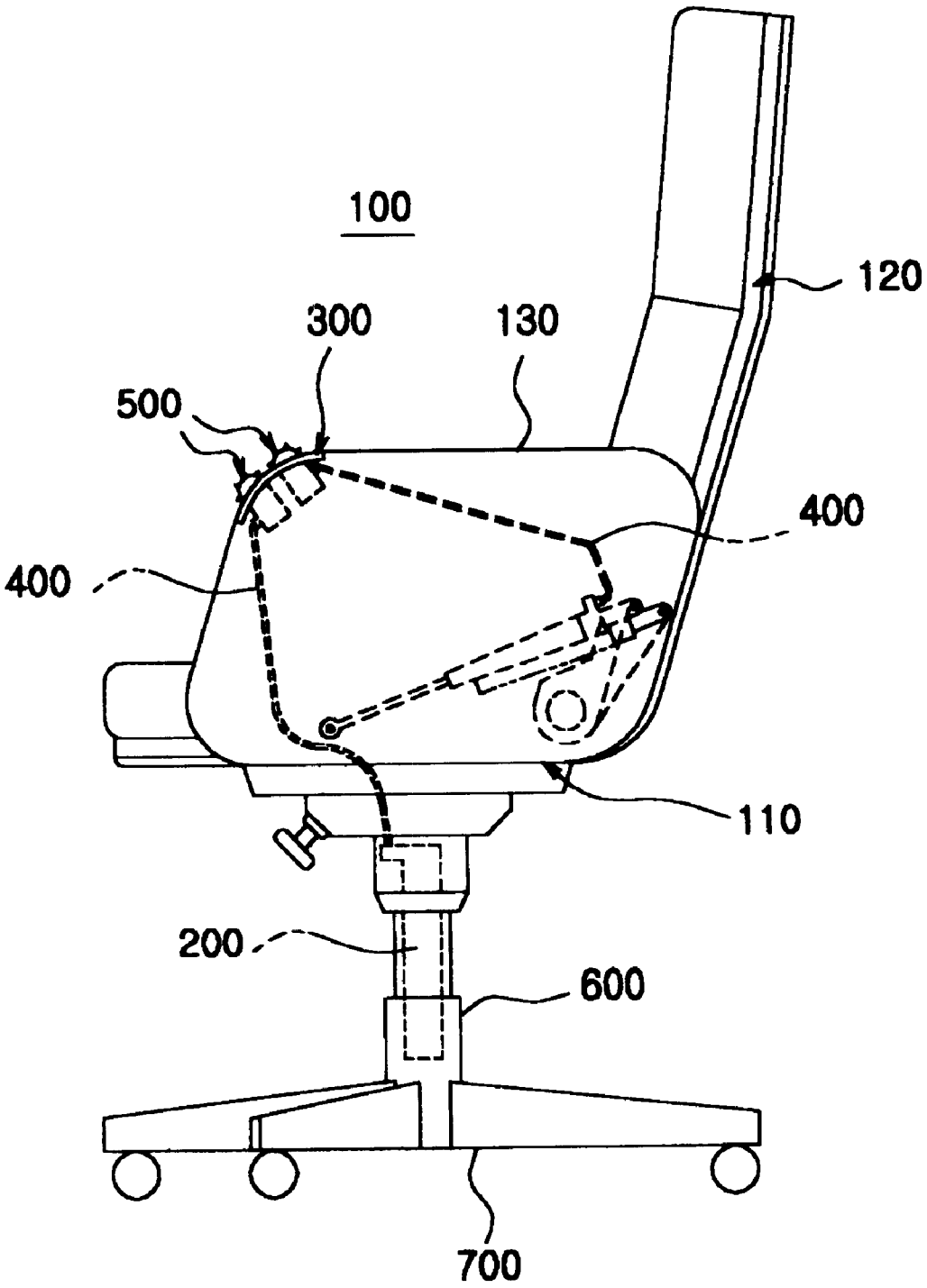
FIG. 4 is the schematic side view of the chair adopting oil-cylinder for adjustment of height and for adjustment of slant of chair in accordance with this invention.

FIG. 4 is the another embodiment of this invention applied to the height adjustment type of chair and the slant adjustment type of chair, wherein the slant of back of chair is adjusted by the gas cylinder 200 mounted in the base of the swivel chair so as to allow the user to sit down on it conveniently. The push button means 300 connected to control valve of gas cylinder 200 formed on the arm rest 130 by the control rod 210 not only provides adjustment function to adjust the slant of back 120 and to adjust the height, but also provides the massaging function with the palm of hand. The massaging function with the palm of hand helps circulation of blood and accordingly can stimulate the whole body.

The technical composition of the palm massage can be changed into another having the same function and any means to mount the palm massage can be adopted therein.

As above, the palm massaging means 500 having many protrusions 510 on its exterior surface is formed on the arm rest 130 so as to be rotated therein so that upon the push operation of push button by user, the protrusions can stimulate the palm to help circulation of blood in the human body that results in healthy living.

And, in accordance with the construction as above, upon the push operation of palm massaging means 500, the tension base 330 moves downwardly and the wire cable 410 connected to the one side of it is pulled.

Further, as generally known, the push button means 300 and wire cable 400 operated by the bracket 210 and lever 220 installed on the gas cylinder 200 is connected to the wire 410 of the wire cable 400 so that the pulling operation of wire 410 is to press control rod 230 of gas cylinder 200 to allow contraction operation of piston axis of the gas cylinder as shown in FIG. 3.

The push button used as palm massage explained above may be formed on the right arm rest or left arm rest or both arm rests.

As explained in detail hereinbefore, this invention provides adjustment function of height of chair or slant of back of chair, and provides the massaging function to massage the palm relevant respective portion of body. Thus, it is very satisfactory to guarantee the healthy living.

What is claimed is:

1. A swivel chair apparatus comprising:

a chair having a back and an armrest and a seat, said seat being supported above a base;

a gas cylinder means connected to said chair, said gas cylinder means for controlling an orientation of one of said seat and seat back, said gas cylindrical means having a control valve cooperative with a control rod;

a frame positioned in said armrest, said frame having a bar supported resiliently by a spring within said armrest;

a wire cable connected to said bar and to said control rod such that a movement of said bar causes a corresponding movement of said control rod so as to actuate said control valve of said gas cylinder means; and a push button rotatably mounted on said frame and above said bar, said push button having multiple spaced apart protrusions extending outwardly from an exterior surface thereof.

2. The apparatus of claim 1, said gas cylinder means for controlling a distance between said seat and said base.

3. The apparatus of claim 1, said gas cylinder means for controlling an angle of inclination of said backrest relative to said seat.

* * * * *